US008881545B2

(12) United States Patent
Lee et al.

(10) Patent No.: US 8,881,545 B2
(45) Date of Patent: Nov. 11, 2014

(54) REFRIGERATOR

(75) Inventors: Su-Won Lee, Gyeongsangnam-do (KR); Kee-Joo Kim, Gyeongsangnam-do (KR); Sung-Eun Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 430 days.

(21) Appl. No.: 13/266,132

(22) PCT Filed: Sep. 3, 2009

(86) PCT No.: PCT/KR2009/004956

§ 371 (c)(1),
(2), (4) Date: Oct. 25, 2011

(87) PCT Pub. No.: WO2010/131802

PCT Pub. Date: Nov. 18, 2010

(65) Prior Publication Data

US 2012/0042679 A1 Feb. 23, 2012

(30) Foreign Application Priority Data

May 12, 2009 (KR) ..... 10-2009-0041055

(51) Int. Cl.

*F25D 11/00* (2006.01)
*F25D 17/06* (2006.01)
*F25D 23/12* (2006.01)

(52) U.S. Cl.

CPC ..... *F25D 17/065* (2013.01); *F25D 23/126* (2013.01); *F25D 2400/20* (2013.01); *F25D 2400/38* (2013.01)

USPC ..... 62/389

(58) Field of Classification Search

CPC ..... F25D 3/06; F25D 11/00; F25D 11/025; F25D 11/003; F25D 11/006; F25D 13/02; F25D 13/067; F25D 16/00; F25D 17/00; F25D 17/06; F25D 17/065; F25D 23/00; F25D 23/025; F25D 31/002; F25D 31/007; F25D 2303/08; F25D 2303/083; F25D 2400/12; F25D 2400/20; F25D 2400/38; F25D 3/12; F25D 23/126; F25B 29/00

USPC ..... 62/389, 441, 344; 312/401

See application file for complete search history.

(56) References Cited

U.S. PATENT DOCUMENTS 2,468,719 A * 4/1949 Earle ..... 62/208
3,949,902 A * 4/1976 Thompson ..... 222/129.1

(Continued)

FOREIGN PATENT DOCUMENTS

CN 2692598 Y 4/2005
CN 101178279 A * 5/2008 ..... F25D 3/02

(Continued)

OTHER PUBLICATIONS

PCT International Search Report dated Apr. 16, 2010 for Application No. PCT/KR2009/004956, with English translation, 4 pages.

(Continued)

*Primary Examiner* — Mohammad M Ali
*Assistant Examiner* — Emmanuel Duke
(74) *Attorney, Agent, or Firm* — Fish & Richardson P.C.

(57) ABSTRACT

The present invention relates to a refrigerator.

With the refrigerator according to the embodiment of the present invention, the refrigerator provided with the freezing cycle is provided to be movable outdoors, making it possible to freshly preserve food outdoors.

12 Claims, 4 Drawing Sheets

(56) References Cited

U.S. PATENT DOCUMENTS

| | | | | | |
|---|---|---|---|---|---|
| 4,225,059 | A | * | 9/1980 | Kappos | 222/146.6 |
| 4,881,590 | A | * | 11/1989 | Meier | 165/48.1 |
| 5,056,686 | A | * | 10/1991 | Jarrett | 222/129.2 |
| 5,176,297 | A | * | 1/1993 | Mooney et al. | 222/325 |
| 5,626,353 | A | * | 5/1997 | Campbell | 280/47.35 |
| 7,210,545 | B1 | * | 5/2007 | Waid | 180/65.1 |
| 2006/0218958 | A1 | * | 10/2006 | Rand et al. | 62/302 |
| 2007/0228909 | A1 | * | 10/2007 | Hwang et al. | 312/408 |

FOREIGN PATENT DOCUMENTS

| | | | | | |
|---|---|---|---|---|---|
| FR | 2835045 | A1 | * | 7/2003 | F25D 3/06 |
| FR | 2835045 | A1 | * | 7/2003 | A47F 3/04 |
| GB | 238651 | | * | 8/1925 | A47F 3/04 |
| GB | 435476 | A | * | 9/1935 | |
| JP | 2002357383 | A | * | 12/2002 | F25D 3/12 |
| KR | 10-1997-0028362 | A | | 6/1997 | |
| KR | 10-1997-0028398 | A | | 6/1997 | |
| KR | 1995-0041316 | A | | 6/1997 | |
| KR | 20-1999-0017287 | U | | 5/1999 | |
| KR | 1997-0030734 | U | | 5/1999 | |
| KR | 10-1999-0055523 | A | | 7/1999 | |
| KR | 20-1999-0032727 | U | | 7/1999 | |
| KR | 1997-0045492 | U | | 7/1999 | |
| KR | 1997-0075471 | A | | 7/1999 | |
| KR | 19990055523 | | * | 7/1999 | F25D 11/00 |
| KR | 1019990055523 | | * | 7/1999 | F25D 11/00 |

OTHER PUBLICATIONS

Chinese Office Action dated May 27, 2013 for Application No. 200980158800.3, with English Translation, 14 pages.

* cited by examiner

REFRIGERATOR

TECHNICAL FIELD

The present invention relates to a refrigerator.

BACKGROUND ART

Generally, a refrigerator, which is an apparatus that intends to store foods at a low temperature, is constituted to keep foods in a frozen or refrigerated state according to the sort of foods to be preserved.

The inside of the refrigerator is cooled by cooling air that is continuously supplied, wherein the cooling air is continuously generated by the heat exchanging operation of coolant by a cold cycle passing through the processes of compression-condensation-expansion-evaporation. And, the cooling air supplied into the inside of the refrigerator is transferred evenly to the inside of the refrigerator by convection so that the foods inside the refrigerator can be stored at a desired temperature.

Generally, the refrigerator is provided to be fixedly installed at home or business places, the refrigerator being provided not to be easily moved by a user.

Meanwhile, a party culture that people spend a leisure-time, while cooking food outdoors has been recently developed regardless of home or abroad. In order for people to enjoy the party that they cook food outdoors, food should be preserved outdoors not to be spoiled and tableware such as dishes, etc. for serving food thereon should be required. Various beverages are also required to be preserved in a cool state.

Most of outdoor parties are made in the season where the weather is warm so that food is likely to be easily spoiled and beverages are likely to be commonly lukewarm. In order to prevent the problems, an ice-box has been used or food stored in the refrigerator at home has been taken-out whenever it is needed in the related art. When using the ice-box, if ice is completely melted, the function thereof cannot be perfectly performed and further, if food is not packed, the ice-box cannot be used fundamentally. Also, when a user takes-out food from the refrigerator at home, it is very troublesome and it takes a long time.

Moreover, all of the food and the tableware are preserved in an exposed state, foreign material such as dust, etc. may be stuck, causing a problem in sanitation.

DISCLOSURE

Technical Problem

The present invention proposes to overcome the above problems. It is an object of the present invention to provide a movable refrigerator that can freshly preserve food outdoors, in a case of an outdoor party.

Moreover, it is an object of the present invention to provide a refrigerator that can preserve tableware to be used in a party in a clean state.

Further, it is an object of the present invention to provide a refrigerator having a dispenser that can provide beverages conveniently.

In addition, it is an object of the present invention to provide a refrigerator that can preserve ice to be used in a party not to be melt.

Moreover, it is an object of the present invention to provide a refrigerator that can be conveniently moved by a user.

Technical Solution

In order to achieve the above objects, according to one embodiment of the present invention, there is provided a refrigerator including: a main body that forms an external appearance; wheels that are provided at the lower end portions of the main body, the wheels being provided so that the main body is to be moved; a handle that is provided at the rear side of the main body and guides the movement direction of the main body; a first storage chamber that is opened to one side direction of the main body; a second storage chamber that is opened to the other side direction of the main body; a first storage chamber door that is coupled to the main body to selectively open and close the first storage chamber; and a second storage chamber door that is coupled to the main body to selectively open and close the second storage chamber.

Advantageous Effects

With the refrigerator according to the embodiment of the present invention as described above, the refrigerator provided with the freezing cycle is provided to be movable outdoors, making it also possible to freshly preserve food outdoors.

Moreover, the space for receiving the tableware to be used in the party is provided separately, making it possible to provide the clean tableware to the party.

Further, the cup holder and the beverage dispenser for supplying beverage conveniently are provided, making it possible for the party attendants to be always supplied with beverage in cups.

In addition, the ice bank that is maintained at subzero temperatures in order to preserve ice is provided, making it possible to preserve ice outdoors, not being melt.

MODE FOR INVENTION

Hereinafter, the exemplary embodiments for implementing the idea of the present invention will be described in detail with reference to the accompanying drawings.

Figure 1:
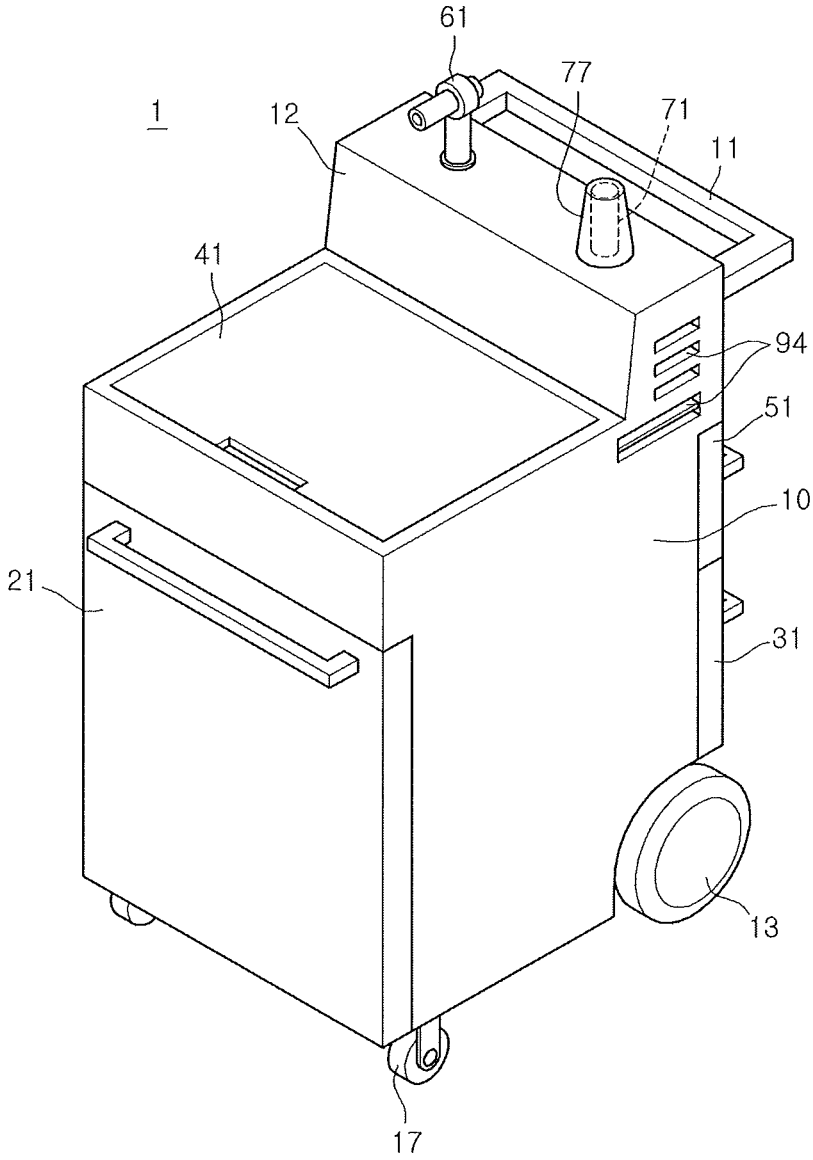
FIG. 1 is a diagram showing the external appearance of a refrigerator according to the embodiment of the present invention.
Figure 2:
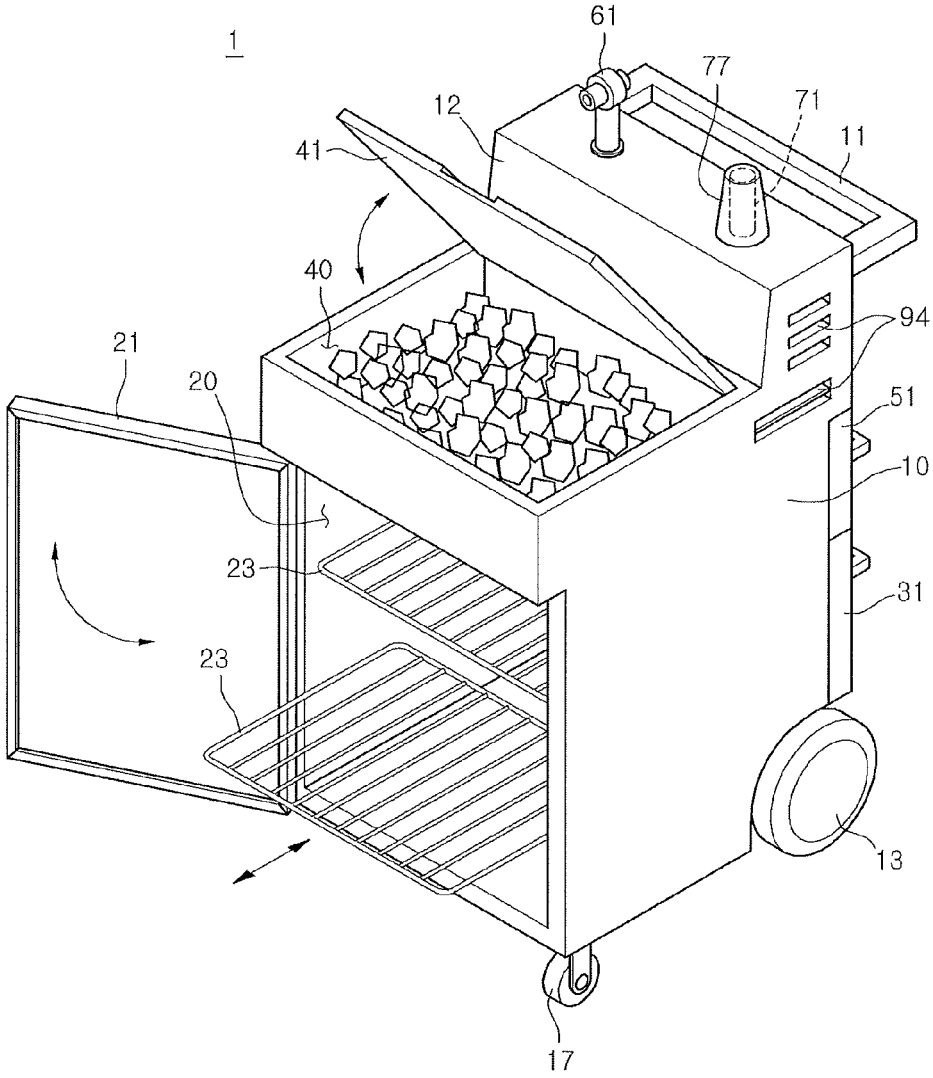
FIG. 2 is a diagram showing that the ice bank and the first storage chamber of the refrigerator of FIG. 1 are used.
Figure 3:
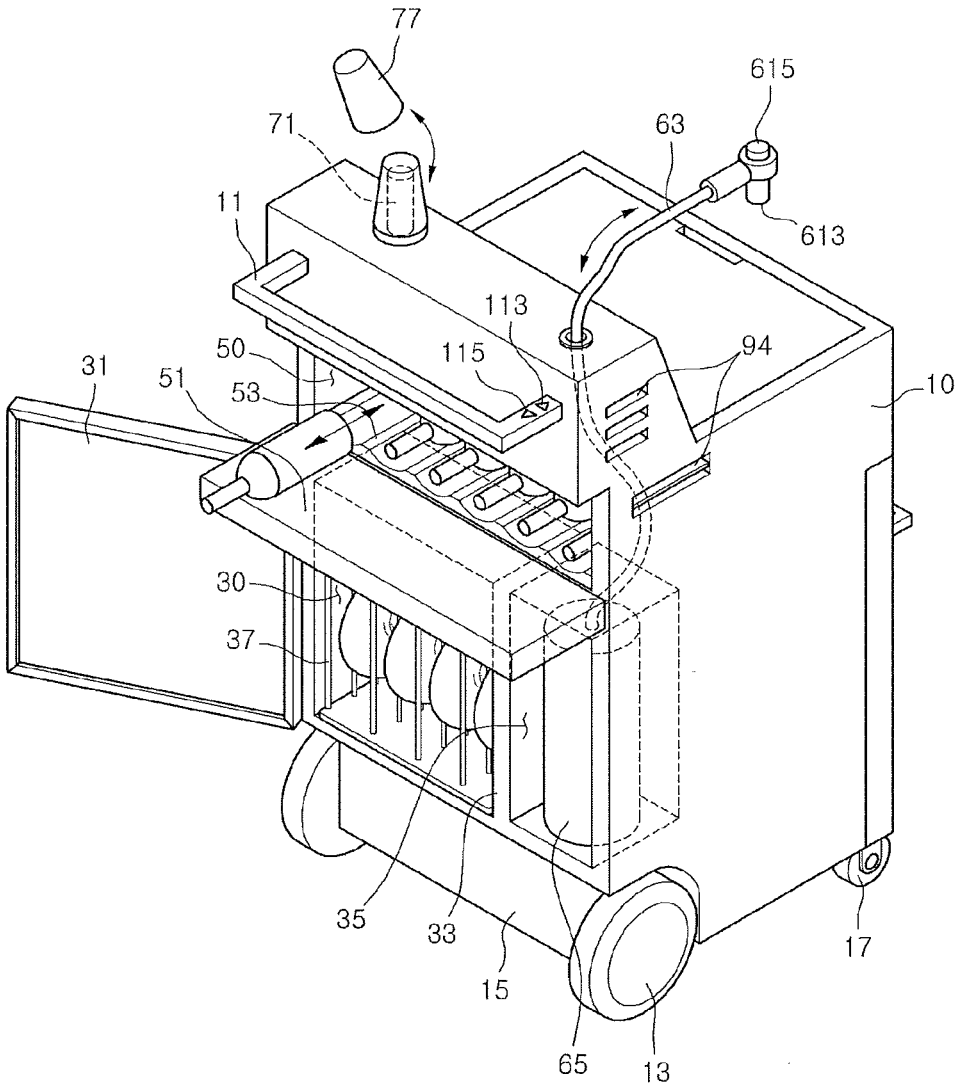
FIG. 3 is a diagram showing that the second storage chamber, the bottle storage chamber, the beverage dispenser, and the cup holder of the refrigerator of FIG. 1 are used.

FIG. 1 is a diagram showing the external appearance of a refrigerator according to the embodiment of the present invention, FIG. 2 is a diagram showing that the ice bank and the first storage chamber of the refrigerator of FIG. 1 are used, and FIG. 3 is a diagram showing that the second storage chamber, the bottle storage chamber, the beverage dispenser, and the cup holder of the refrigerator of FIG. 1 are used.

Referring to FIGS. 1 to 3, the refrigerator 1 according to the embodiment of the present invention includes a main body 10 that forms an external appearance, a first storage chamber 20 that is provided in front of the main body 10, an ice bank 40 that is provided on the upper side of the first storage chamber 20, a second storage chamber 30 that is provided at the rear side of the first storage chamber 20, and a bottle storage chamber 50 that is provided on the upper side of the second storage chamber 30.

The main body 10 is formed in an approximately rectangular box-shape, wherein a storage space where food and tableware, etc. can be received is formed therein. The main body 10 may be configured of an outer case formed of metal material and an inner case formed of plastic material, and at this time, the space between the outer case and the inner case may be filled with foaming liquid for heat insulation.

A projection part 12 that is projected at a predetermined height is provided on the rear upper end portion of the main body 10. A machine chamber 90 (FIG. 4) to which constituents that form a freezing cycle for supplying cooling air to the storage space are mounted is provided inside the projection part 12. Ventilation holes 94 are formed on both side surfaces of the projection part 12 so that air can go in and out the inside of the machine chamber 90.

Further, a handle 11 that moves the refrigerator 1 is provided at the rear side of the projection part 12. The handle 11 may be extended at a length corresponding to the horizontal width of the main body 10 so that a user can easily grasp it to apply force thereto.

Meanwhile, the first storage chamber 20 is opened to the front of the main body 10 and is selectively opened and closed by a first storage chamber door 21 that is rotatably coupled to the front one side of the main body 10. A plurality of shelves 23 are provided inside the first storage chamber 20 to be forwardly slidingly taken in and out. To this end, a guide structure (not shown) for guiding the slid movement may be provided on both sides of the first storage chamber 20.

The cooling air generated from the freezing cycle is supplied to the first storage chamber 20, making it possible to be used in preserving food at low temperature. The supply amount of the cooling air may be controlled so that the first storage chamber 20 is maintained at a temperature (about −5° C.) that food can be preserved in a refrigerated state. The structure where the cooling air is supplied to the first storage chamber 20 will be described later.

The ice bank 40 is provided on the upper side of the first storage chamber 20. The ice bank 40 is provided in an approximately rectangular box shape on the upper end portion of the main body 10, and is positioned in front of the projection part 12. The ice bank 40 is opened to the upper of the main body 10 and is selectively opened and closed by an ice bank cover 41 that is rotatably coupled to the upper surface of the main body 10. The ice bank cover 41 is positioned horizontally to the ground so that food or tableware, etc. can be put thereon when it covers the ice bank 40. Therefore, the user can use the ice bank cover 41 as a shelf.

Further, the ice bank 40 is constituted to be supplied directly with the cooling air generated from the freezing cycle. Therefore, the inside of the ice bank 40 can be maintained at a temperature (about −18° C.) that food can be preserved in a frozen state, and the ice stored in the ice bank 40 can be maintained in an ice state, not being melt. The detailed description related thereto will be described later.

The second storage chamber 30 is provided at the rear side of the first storage chamber 20. The first storage chamber 20 and the second storage chamber 30 are partitioned by a predetermined barrier to be provided as spaces independent from each other. The second storage chamber 30 are opened to the rear of the main body 10 and is selectively opened and closed by a second storage door 31 that is rotatably coupled to the rear surface of the main body 10.

A tableware rack 37 that can receive tableware such as dishes, etc. is provided inside the second storage chamber 30. The tableware rack 37 is provided to be slidingly movable forward and backward so that the user can receive tableware conveniently. Shelves that can receive food in the same manner as the first storage chamber 20 may further be provided on the upper side of the tableware rack 37.

A storage container receiving part 35 in which a beverage storage container 65 coupled to a beverage dispenser 61 to be described later is stored is provided on one side of the second storage chamber 30. The storage container receiving part 35 is partitioned by the second storage chamber 30 and a partition 35, wherein it may also be opened and closed by the second storage chamber door 31. Beverage is pressured under high pressure to be stored in the beverage storage container 65. The beverage storage container 65 is provided to be detachably coupled to a hose 63 to be described later to be replaced after using the entire beverage stored therein. In other words, when the beverage stored in the beverage storage container 65 is exhausted, the user opens the second storage chamber door 31 and separates the connection between the beverage storage container 65 and the hose 63, thereby making it possible to replace it with another beverage container.

Moreover, the beverage storage container 65 may also be configured to be supplied together with carbon dioxide. For example, a carbon dioxide container is provided on one side of the beverage storage container 65 and the carbon dioxide container is connected to the hose 63 so that beverage may be supplied together with carbon dioxide.

The bottle storage chamber 50 that can receive liquor such as wine, etc. or beverage bottles, etc. is provided on the upper side of the second storage chamber 30. The bottle storage chamber 50 is positioned under the projection part 12 and is formed to be deep forward and backward so that bottles such as wine bottles, etc. can be received. The bottle storage chamber 50 is opened to the rear of the main body 10 and is selectively opened and closed by a bottle storage chamber door 51 rotatably coupled to the rear surface of the main body 10. And, a predetermined buffer member 53 that can absorb impact, such as sponge, memory foam, etc., may be provided on the bottom surface of the bottle storage chamber 50 in order to prevent the vibration and damage of the bottles.

Meanwhile, a cup holder 71 into which a cup 77 can be inserted and a beverage dispenser 61 that can supply beverage stored in the beverage storage container 65 are provided on the upper side of the projection part 12.

More specifically, the cup holder 71 is projected at a predetermined length from the upper surface of the projection part 12, having a cylindrical shape. The cup holder 71 may be formed having a diameter corresponding to the inner diameter of the cup so that the cup will not be fluctuated even though the refrigerator 1 is moved. The user may insert cups into the cup holder 71 in sequence and take out them, if necessary.

The beverage dispenser 61 is connected to the beverage storage container 65 by the hose 63. The hose 63 is provided to be extendable at a predetermined length. More specifically, a seating part on which the beverage dispenser 61 can be hung is provided on the projection part 12, wherein when the beverage dispenser 61 is not used, the beverage dispenser 61 may be put on the seating part. When the beverage dispenser 61 is used, the hose 63 can be extended at a predetermined length, while pulling the beverage dispenser 61, so that the user can provide beverage at his or her desired position.

A valve is provided inside the beverage dispenser 61 to selectively block the supply of beverage. The beverage dispenser 61 includes a press part 615 that operates the valve and a discharge hole 613 that discharges beverage. Since beverage is stored in the beverage storage container 65 under high pressure, if the valve of the beverage dispenser 61 is opened by the operation of the press part 615, the beverage is moved along the hose 63, making it possible to be discharged through the discharge hole 613.

Driving wheels 13 and auxiliary wheels 17 that move the refrigerator 1 are provided at the lower end portion of the main body 10. The driving wheels 13 are connected to a driver 15 provided at the rear lower end portion of the main body 10 to allow the refrigerator 1 to move forward and backward. The driver 15 includes a motor that is connected to a power supplying part such as an external power supply or a battery, etc. to be electrically driven, and the driving wheels 13 are connected to the motor to be rotated.

Meanwhile, a forward button 113 that moves the refrigerator 1 forward and a backward button 115 that moves the refrigerator 1 backward may be provided on the handle 11. Therefore, the user can operate the movement of the refrigerator 1 conveniently, while grasping the handle 11.

Figure 4:
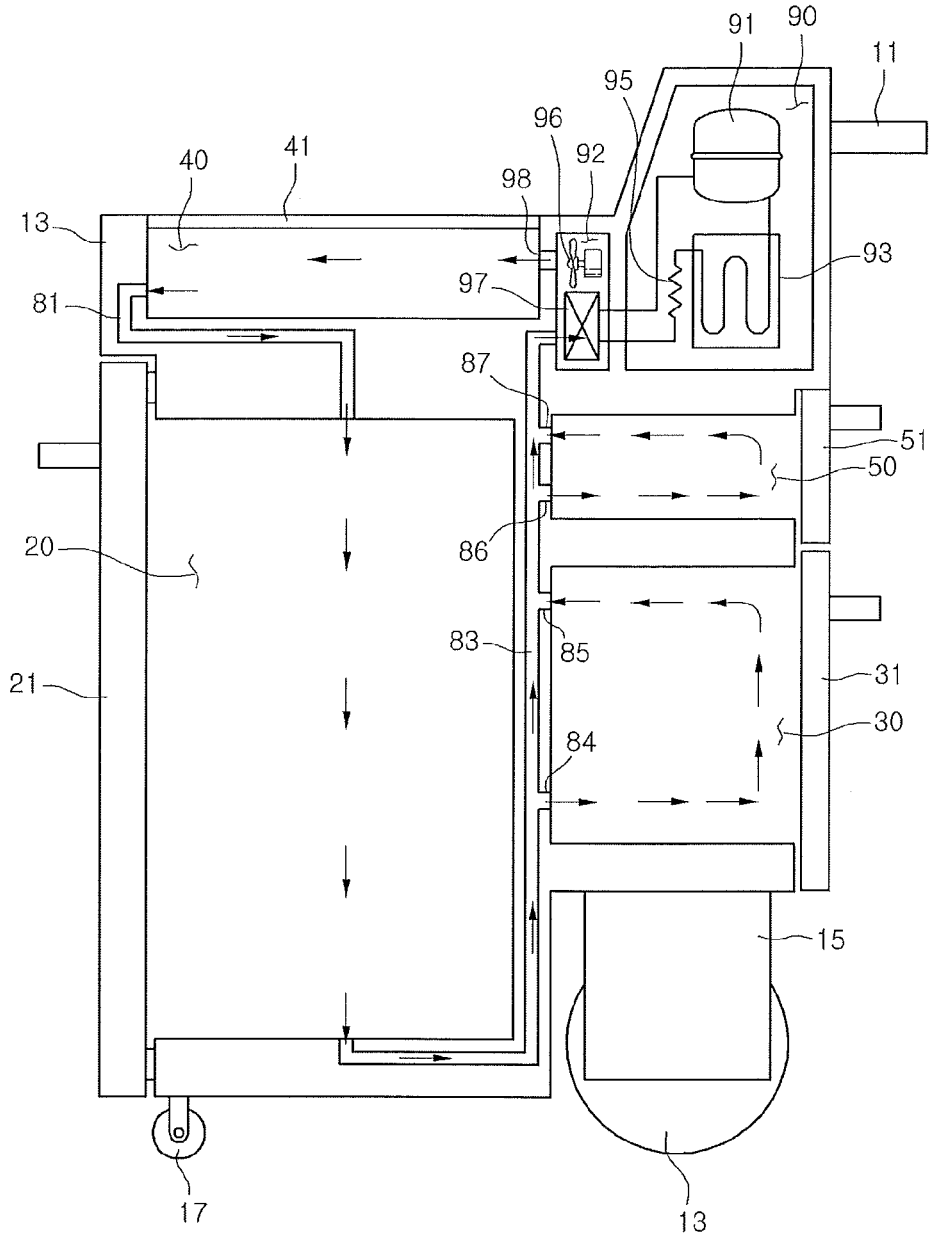
FIG. 4 is a diagram showing the internal constitution of the refrigerator of FIG. 1.

FIG. 4 is a diagram showing the internal constitution of the refrigerator of FIG. 1.

Referring to FIG. 4, a machine chamber 90 including a compressor 91, a condenser 93, and an expansion member 95 that form a freezing chamber is provided on the rear upper end portion of the main body 10. The machine chamber 90 is also extended inward the projection part 12 so that the size of various storage spaces provided in the main body 10 can be maximized. Further, a cooling fan that expedites heat transfer may further be provided on one side of the condenser 93.

A cooling air generating chamber 92 that generates cooling air is provided in the space between the machine chamber 90 and the ice bank 40. An evaporator 97 that performs heat exchange between coolant and air to generate cooling air and a blowing fan 96 that discharges the cooling air generated from the evaporator 97 to the inside of the ice bank 40 are provided in the cooling air generating chamber 92. A cooling air discharge hole 98 that allows the cooling air generating chamber 92 to be communicated with the ice bank 40 is formed in front of the blowing fan 96.

Describing the freezing cycle having the constitution as described above, coolant is compressed into a gas state of a high temperature and a high pressure gas in the compressor 91, and is flowed into the condenser 93 to be condensed into a liquid state. The pressure of the coolant condensed into a liquid state as its heat is taken away in the condenser 93 becomes low, while passing through the expansion member 95, to be a mixed state of saturated liquid-vapor. The coolant in the saturated liquid-vapor state is flowed into the evaporator 97. The evaporator 97 absorbs heat from the peripheral air to evaporate the coolant to a state being close to saturated vapor. Therefore, the temperature of the peripheral air of the evaporator 97 becomes low. In other words, cooling air is generated. The evaporated cooling air is flowed again into the compressor 91 to repeat the process as described above, thereby completing the freezing cycle.

The compressor 91 is supplied with power from the external power supply connected to the refrigerator 1 through a wire, making it possible to drive a compressing equipment stored therein. A battery is mounted to one side of the machine chamber 90 so that power can be supplied therefrom. Since there may be a case where the refrigerator 1 is used outdoors for a long time, it would be desirable that power is supplied from the external power supply through a wire.

Hereinafter, the circulation of the cooling air generated from the cooling air generating chamber 92 will be described.

The cooling air flowed into the inside of the ice bank 40 through the cooling air discharge hole 98 cools ice stored in the ice bank 40 and moves to the first storage chamber 20 along a cooling air channel 81 communicating with the ice bank 40 and the first storage chamber 20. The outlet of the cooling air channel 81 may be formed on the ceiling surface of the first storage chamber 20 so that the cooling air can be smoothly discharged downward. Also, a damper that controls the amount of the cooling air can be provided on the cooing air channel 81. The damper provided on the cooling air channel 81 can control the cooling air flowed into the first storage chamber 20 so that the first storage chamber 20 can function as a refrigerating chamber.

The cooling air flowed into the first storage chamber 20 is flowed into a return channel 83 that keeps the food stored in the first storage chamber 20 in a cooled state or a low temperature state and is connected to the bottom surface of the first storage chamber 20. The return channel 83 is extended from the bottom surface of the first storage chamber 20 to the cooling air generating chamber 92.

A channel 84 that supplies cooling air to the second storage chamber 30 and a channel 85 into which the cooling air that has circulated the second storage chamber 30 is flowed are connected to the return channel 83. Also, a channel 86 that supplies the cooling air to the bottom storage chamber 50 and a channel 87 into which the cooling air that has circulated the bottle storage chamber 50 is flowed are connected to the return channel 83. At this time, a predetermined damper is provided on the channels 84 and 86 that supply cooling air to the second storage chamber 30 and the bottle storage chamber 50, making it possible to control the amount of the supplied cooling air.

Meanwhile, the ice bank 40 uses a cool storage material bag filled with predetermined cool storage material, not using cooling air, making it possible to prevent ice from being melt. In other words, the ice bank 40 may also be cooled in a cooling scheme by conduction rather than in a cooling scheme by convection of cooling air. In this case, the cool storage material bag is provided to surround the ice bank 40 and the compressor 91 may compress cooling air up to a relatively low temperature, making it possible to reduce power consumption.

Moreover, the first storage chamber 20, the second storage chamber 30, and the bottle storage chamber 50 may be provided not only in a scheme that they are cooled by the convection of cooling air but also in a scheme that they are cooled by the conduction as the predetermined cool storage material bag is provided to surround the storage spaces 20, 30, and 50.

With the refrigerator 1 according to the embodiment of the present invention as described above, the refrigerator provided with the freezing cycle is provided to be movable outdoors, making it possible to freshly preserve food outdoors.

Further, the space for receiving tableware to be used in a party (the second storage chamber in the present embodiment) is provided inside the refrigerator 1 and such a space is formed independently from a space for receiving food (the first storage chamber in the present invention), making it possible to provide clean tableware.

Moreover, the cup holder 71 and the beverage dispenser 61 are provided in order to supply beverage conveniently, making it possible for the party attendants to be always supplied with beverage using cups.

In addition, the ice bank 40 that is maintained at subzero temperatures in order to preserve ice is provided, making it possible to preserve ice outdoors, not being melt.

The scope of the present invention is not limited to the embodiment set forth herein, but modification, adding and removing can be made in the present invention without departing from the spirit and scope of the invention.

With the present invention, the refrigerator provided with the freezing cycle is provided to be movable outdoors so that food can also be freshly preserved outdoors, having industrial applicability.

The invention claimed is:

1. A refrigerator comprising: a main body that defines an external appearance; wheels that are located on a lower portion of the main body and that are configured to allow the main body to move through a movement plane; a handle that is located on a rear side of the main body; a first storage chamber that is accessible through a front side of the main body; a first storage chamber door that is coupled to the main body and configured to open and close the first storage chamber; a second storage chamber that is accessible through the rear side of the main body opposite from the front side of the main body; an ice storage chamber that is located on an upper portion of the first storage chamber; an ice storage chamber cover that is hinged to an upper portion of the main body and configured to open and close the ice storage chamber by rotating about a hinge axis that is substantially parallel to the movement plane; a machine chamber that includes a compressor, a condenser, and an expansion member that perform a freezing cycle; and a cooling air generating chamber that includes an evaporator through which cooling air passing through the expansion member flows and that cools air circulating through the first storage chamber and the second storage chamber, wherein the ice storage chamber is adjacent to the first storage chamber and configured to allow cooling air to flow from the ice storage chamber to the first storage chamber.

2. The refrigerator according to claim 1, further comprising:

a second storage chamber door that is coupled to the main body and configured to open and close the second storage chamber, wherein the second storage chamber is located at a rear side of the first storage chamber and is independent of the first storage chamber.

3. The refrigerator according to claim 1, wherein the ice storage chamber cover is substantially flat and substantially parallel to the movement plane when closed.

4. The refrigerator according to claim 1, wherein a bottle storage chamber is (i) accessible through the rear side of the main body, (ii) configured to be longer in a direction substantially parallel to the movement plane than in a direction substantially perpendicular to the movement plane, and (iii) located above the second storage chamber, and, wherein a buffer member is provided on a bottom surface of the bottle storage chamber.

5. The refrigerator according to claim 1, further comprising:

a projection part that is located on an that the upper portion of the main body, wherein at least a portion of the machine chamber is located inside the projection part, and wherein the cooling air generating chamber is located between the ice storage chamber and the machine chamber.

6. The refrigerator according to claim 1, further comprising: a bottle storage chamber that is (i) located above the second another storage chamber, (ii) accessible through the rear side of the main body, and (iii) configured to be longer in a direction substantially parallel to the movement plane than in a direction substantially perpendicular to the movement plane, wherein cooling air generated from the cooling air generating chamber is discharged to the ice storage chamber and passes through the bottle storage chamber back into the cooling air generating chamber.

7. The refrigerator according to claim 1, wherein a beverage storage container is located adjacent to the second storage chamber, and a beverage dispenser that is coupled to the beverage storage container and configured to selectively discharge liquid stored in the beverage storage container.

8. The refrigerator according to claim 1, further comprising a cup holder located on the upper portion of the main body.

9. The refrigerator according to claim 1, further comprising a motor that is located in the lower portion of the main body is configured to rotate the wheels.

10. The refrigerator according to claim 9, further comprising buttons that are configured to activate the motor to rotate the wheels and are located on the handle.

11. The refrigerator according to claim 1, wherein a tableware rack that is configured to store tableware is located in the first storage chamber or the second storage chamber.

12. The refrigerator according to claim 1, wherein the first storage chamber and the second storage chamber are surrounded by a cool storage material bag.

* * * * *